US009114960B2

(12) United States Patent
King et al.

(10) Patent No.: US 9,114,960 B2
(45) Date of Patent: Aug. 25, 2015

(54) CRANE SAFETY DEVICE FOR PREVENTING TRUCK JOSTLING AND/OR HATCH COVER DETECTION

(75) Inventors: Henry King, Moraga, CA (US); Toru Takehara, Foster City, CA (US)

(73) Assignee: HKI Systems and Services LLC, Hayward, CA (US)

( * ) Notice: Subject to any disclaimer, the term of this patent is extended or adjusted under 35 U.S.C. 154(b) by 1324 days.

(21) Appl. No.: 12/748,354

(22) Filed: Mar. 26, 2010

(65) Prior Publication Data

US 2010/0243594 A1 Sep. 30, 2010

Related U.S. Application Data

(60) Provisional application No. 61/163,838, filed on Mar. 26, 2009.

(51) Int. Cl.

| | |
|---|---|
| ***G08B 21/00*** | (2006.01) |
| ***B66C 19/00*** | (2006.01) |
| ***B66C 13/08*** | (2006.01) |
| ***B66C 15/04*** | (2006.01) |
| ***B66C 15/06*** | (2006.01) |
| *B66C 13/46* | (2006.01) |

(52) U.S. Cl.

CPC ..... *B66C 19/007* (2013.01); *B66C 13/085* (2013.01); *B66C 15/045* (2013.01); *B66C 15/065* (2013.01); *B66C 19/002* (2013.01); *B66C 13/46* (2013.01)

(58) Field of Classification Search

CPC ..... B66C 13/46; B66C 13/085; B66C 15/00; B66C 15/045; B66C 15/065; B66C 19/002; B66C 19/007; G08B 21/187

USPC ..... 340/685, 431

See application file for complete search history.

(56) References Cited

U.S. PATENT DOCUMENTS

| | | | | |
|---|---|---|---|---|
| 5,428,344 | A * | 6/1995 | Curry et al. | 340/539.1 |
| 5,455,567 | A * | 10/1995 | Simmons | 340/685 |
| 5,661,465 | A * | 8/1997 | Hung et al. | 340/686.2 |
| 6,252,497 | B1 * | 6/2001 | Dupay et al. | 340/431 |
| 7,123,132 | B2 * | 10/2006 | Heidenback et al. | 340/431 |
| 7,289,876 | B2 * | 10/2007 | Lussen et al. | 700/213 |
| 8,421,640 | B1 * | 4/2013 | Larson | 340/685 |
| 8,686,868 | B2 * | 4/2014 | Stocker et al. | 340/685 |
| 2002/0070870 | A1 * | 6/2002 | Huang | 340/685 |
| 2005/0256608 | A1 * | 11/2005 | King et al. | 700/213 |
| 2006/0115350 | A1 * | 6/2006 | Weis | 414/139.4 |
| 2010/0243593 | A1 * | 9/2010 | King et al. | 212/276 |

FOREIGN PATENT DOCUMENTS

EP 1695936 A1 * 8/2006

* cited by examiner

*Primary Examiner* — Firmin Backer
*Assistant Examiner* — Adnan Aziz
(74) *Attorney, Agent, or Firm* — GSS Law Group

(57) ABSTRACT

A safety device is disclosed for a gantry crane configured to lift containers from a truck driven chassis. The safety device estimates truck movement when the gantry crane lifts the container and sends an alert to avert lifting the truck when the container fails to decouple from the chassis. Motion sensors are disclosed that are configured to coupled to a trolley of a gantry crane and used to create an estimate of the front or back region near a container being lifted. A processor may use the motion sensor signals to avert lifting the truck and/or to avert an Optical Character Recognition (OCR) system reporting a container identification failure when a hatch cover is lifted off of a ship. In various embodiments, the processor may be included in the safety device and/or in the OCR system.

14 Claims, 11 Drawing Sheets

RTG crane 12, Rail Mounted Gantry (RMG) crane 14

CRANE SAFETY DEVICE FOR PREVENTING TRUCK JOSTLING AND/OR HATCH COVER DETECTION

CROSS REFERENCE TO RELATED APPLICATIONS

This invention claims priority to Provisional U.S. Patent Application No. 61/163,838 entitled "Crane Anti-Jostle System and Methods" by inventors Henry King and Toru Takehara, filed Mar. 26, 2009 and incorporated herein by reference.

TECHNICAL FIELD

This invention relates to avoiding jostling trucks as a gantry crane picks up a container and/or detecting a hatch cover being picked up on a ship.

BACKGROUND OF THE INVENTION

Crane safety is a primary concern at any site where container handling gantry cranes are used. One dangerous event occurs when a gantry crane lifts a container that has not been properly decoupled from its chassis and the truck driving it. The crane tends to lift both the chassis and the truck. Averting these dangerous events can save lives and minimize damage done to containers, chassis and trucks in container handling environments such as shipyards and container stacks.

Another problem, while not dangerous leads to added overhead in the management of quay cranes. Optical Character Recognition (OCR) systems employed to identify containers often get confused and fail to recognize a hatch cover, which do not have a container identifying code. This leads to added expense, while it has to be separately confirmed that the lifted object is a hatch cover and not a container.

Averting the truck jostling and eliminating confusing a hatch cover for a container are problems that need solution.

SUMMARY OF THE INVENTION

A safety device is claimed for a gantry crane configured to lift containers from a truck driven chassis. The safety device estimates truck movement when the gantry crane lifts the container and sends an alert to avert lifting the truck when the container fails to decouple from the chassis. The safety device may include a processor configured to respond to motion sensor signals of the truck to create a truck motion estimate and to respond to that estimate by creating at least one alert that may trigger an automated mechanism to avert lifting the truck. The gantry crane may be a rubber tire gantry crane or a rail gantry crane possibly employed as a quay crane.

Other embodiments may include a motion sensor configured for coupling to a gantry crane or its trolley to align with its spreader to create motion sensor signals of the truck as the container is lifted. The motion sensor may include a light source and a light sensor that generates the motion sensor signal in response to the reflections of the light emitted from the light source and reflected off of the truck. The light source may include at least one laser and/or at least one light emitting diode.

The motion sensor signal may be sent to the safety device as the gantry crane is lifting the container off of the chassis. The safety device responds if the truck attached to the chassis moves as the container starts to rise by generating the alert message to avert further lifting of the truck. The safety device may further distinguish normal movements from dangerous ones that lead to lifting the truck such as the truck lifting at about the same velocity as the container being hoisted.

A quay crane may have at least two coupled motion sensors similarly aligned with its spreader to determine if a hatch cover is being lifted and to avert a container identification failure event for an Optical Character Recognition (OCR) system associated with the crane.

DETAILED DESCRIPTION

This invention relates to avoiding jostling trucks as a gantry crane picks up a container and/or detecting a hatch cover being picked up on a ship. A safety device is claimed for a gantry crane configured to lift containers from a truck driven chassis. The safety device estimates truck movement when the gantry crane lifts the container and sends an alert to avert lifting the truck when the container fails to decouple from the chassis. Motion sensors are claimed that are configured to coupled to a trolley of a gantry crane and used to create an estimate of the front or back region near a container being lifted. A processor may use the motion sensor signals to avert lifting the truck and/or to avert an Optical Character Recognition (OCR) system reporting a container identification failure when a hatch cover is lifted off of a ship. In various embodiments, the processor may be included in the safety device and/or in the OCR system.

Figure 1A:
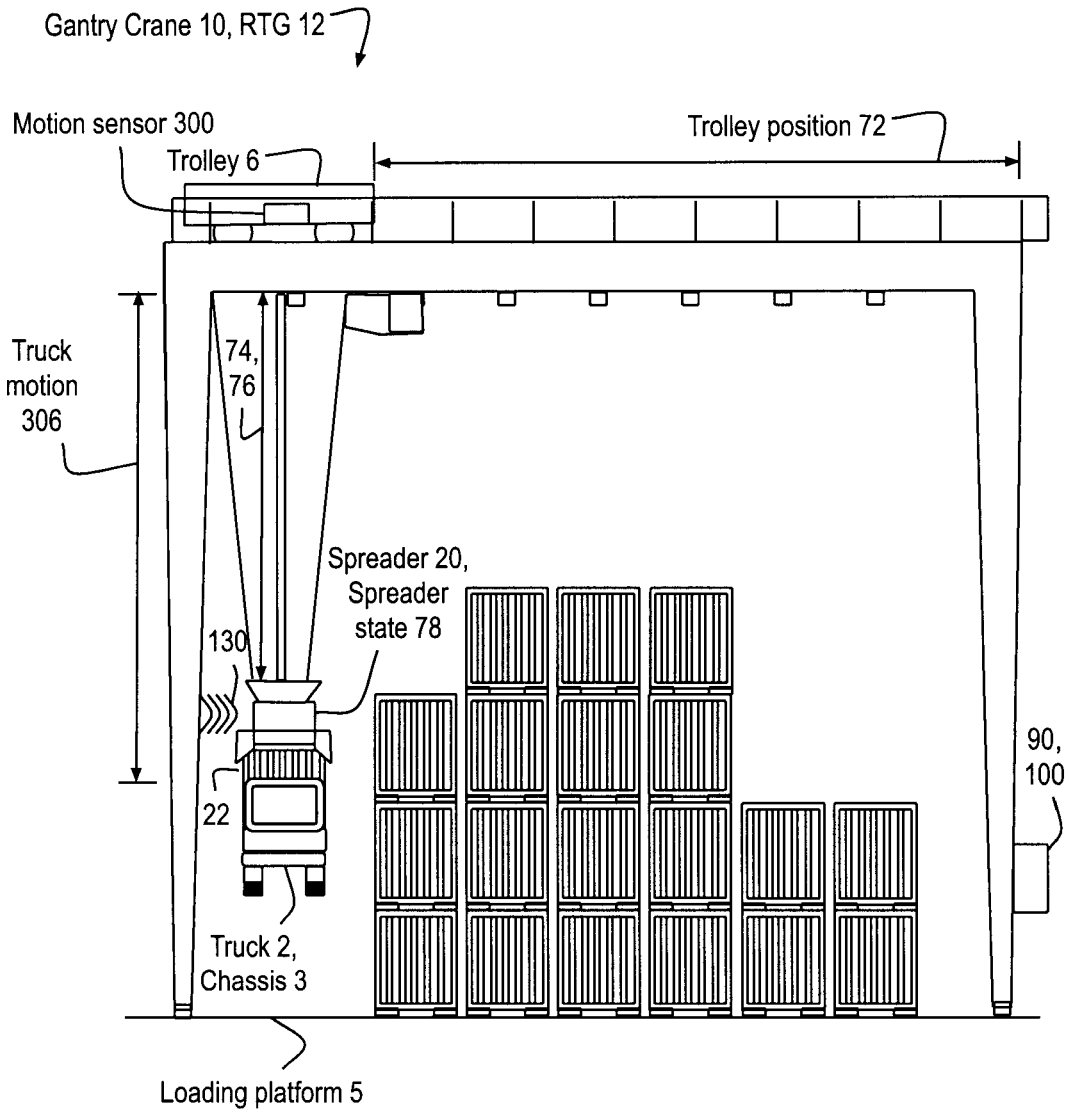
FIGS. 1A to 1C show embodiments of a safety device and processor configured to estimate the motion of a truck as a gantry crane, in particular a rubber tire gantry crane lifts a container from a chassis coupled to the truck. The motion of the truck is estimated by at least one motion sensor aligned to the crane's spreader to estimate truck movement. The safety device averts the truck being lifted as the container fails to decouple from the chassis
Figure 1B:
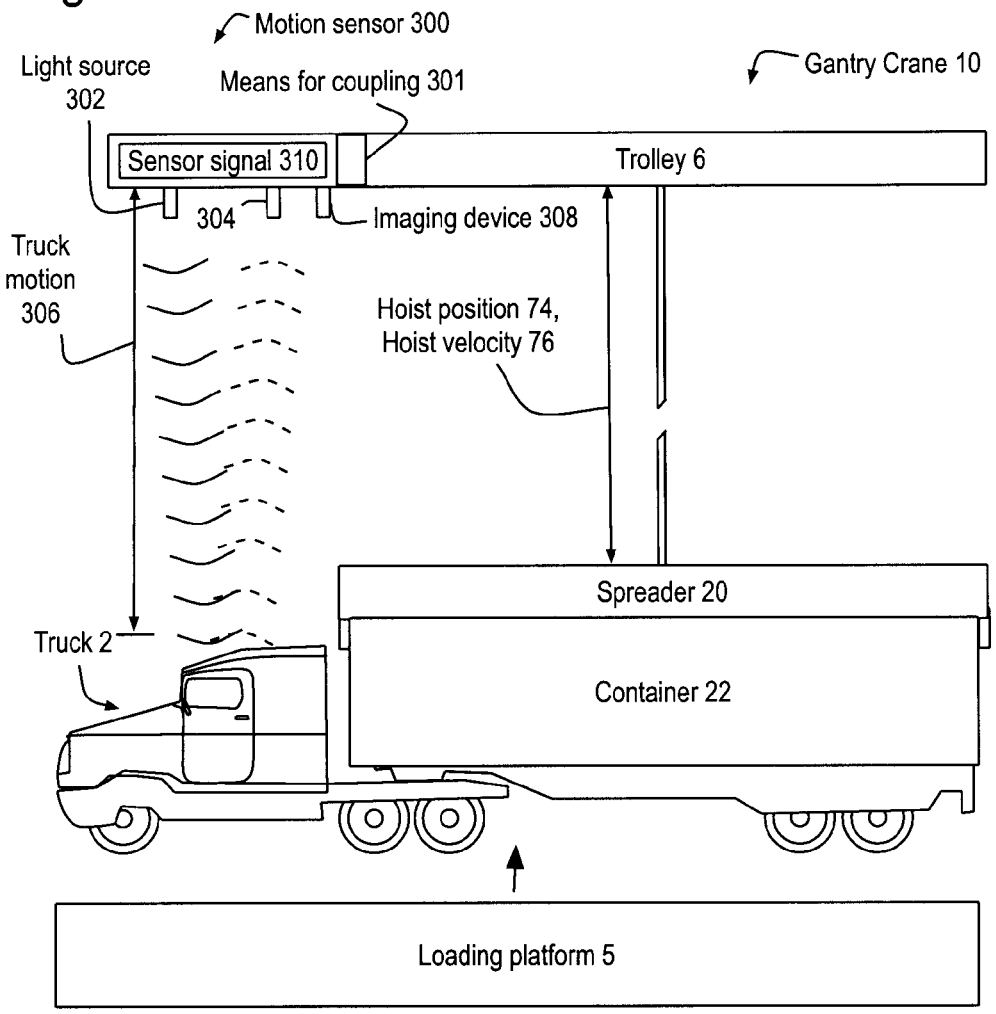
Figure 1C:
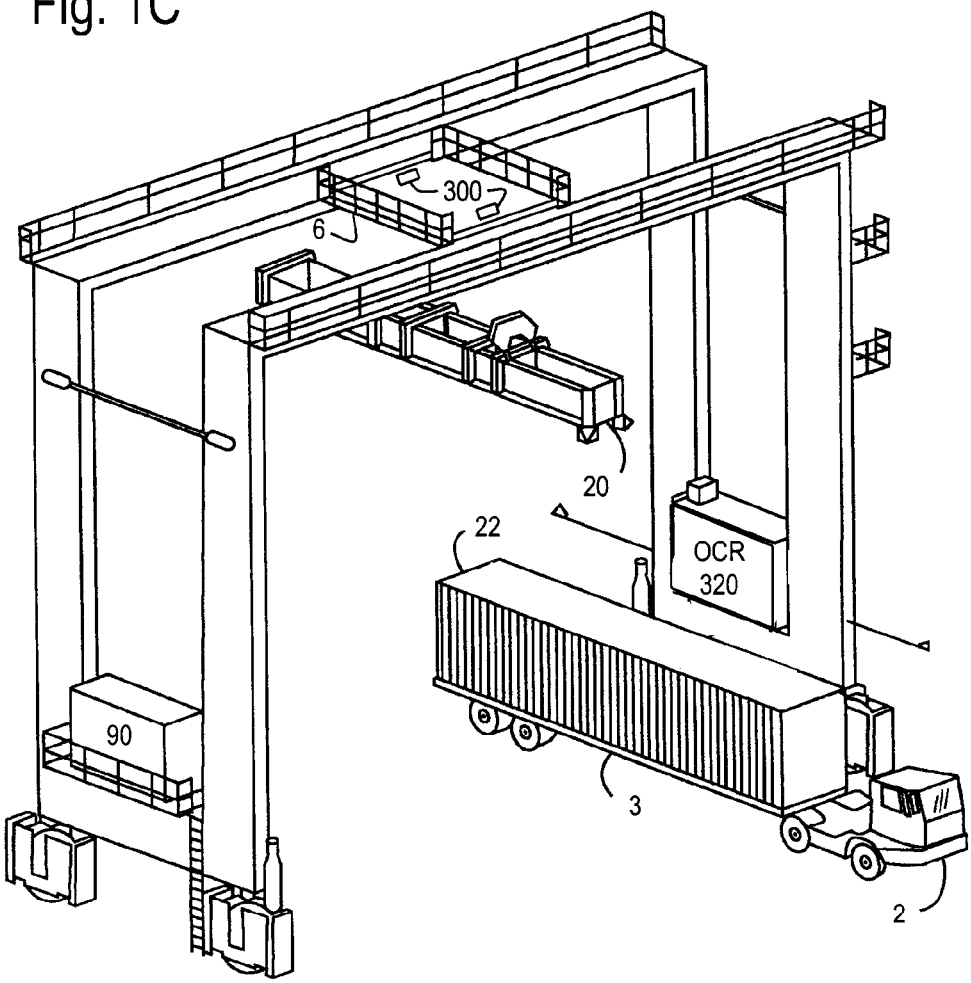

FIGS. 1A to 1C show embodiments of a safety device 90 and processor 100 configured to estimate the motion 306 of a truck 2 as a gantry crane 10, in particular a Rubber Tire Gantry (RTG) crane 12 lifts a container 22 from a chassis 3 coupled to the truck. The motion of the truck is estimated by at least one motion sensor 300 aligned to the crane's spreader 20. The motion sensor's alignment refers to configuring its coupling to the gantry crane to measure the truck's movement as the crane lifts the container. The safety device may avert 130 the truck being lifted off of a loading platform 5 as the container fails to decouple from the chassis. At least one motion sensor 300 may be coupled to the trolley 6, aligned to the spreader 20 and used to estimate the truck motion 306. A hoist position 74 and/or a hoist velocity 76 may be used with the truck motion estimate and a spreader state of the spreader engaging the container to indicate the truck is being lifted.

FIG. 1A shows the truck 2 being lifted as the container 22 fails to decouple from the chassis 3. The trolley position 72 may be used to determine when the spreader 20 is over the container on the chassis.

FIG. 1B shows some details of the motion sensor 300 that may include at least one light source 302 and at least one light sensor 304 and a means for coupling 301 to the trolley 6. The means for coupling may include but is not limited to at least one mechanical coupling that may include a nut and/or a bolt. This Figure also shows that as the spreader 20 engages the container 22 and the hoist position 74 indicates that the container is being lifted, the motion sensor may be operated to activate the light source 302 to emit light that is reflected off of the truck 2 and received by the light sensor 304 to create a motion sensor signal 310 that may be used to estimate the truck motion 306 which may in some embodiments be a height measurement. The motion sensor 300 may include an imaging device 308 that may be used to determine the truck motion 306 and/or to determine if the truck is coupled to the chassis.

FIG. 1C shows the RTG crane 12 may include the safety device 90 separate from the OCR system 320. The trolley may have two motion sensors 300 coupled to it and aligned with the spreader 20 so that the front region where the truck is in this Figure may be sensed by one motion sensor. The other motion sensor may be used if the truck was oriented opposite to this Figure, entering the loading platform from the right rather than the left as shown here. Note that a Rail Mounted Gantry (RMG) crane 14 looks almost exactly liked the RTG crane shown here with the only major difference between them being that the RMG crane is mounted on rails whereas the RTG crane is mounted on rubber tires.

Figure 2:
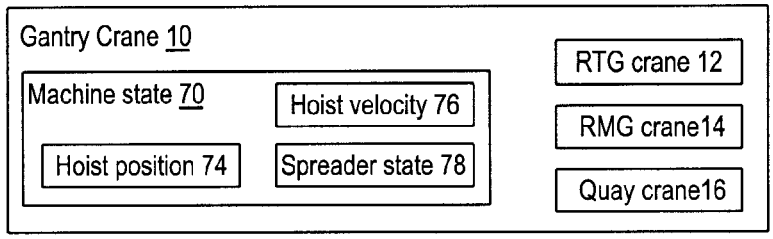
FIG. 2 shows examples of gantry cranes each with a machine state that includes a hoist position, a spreader state and may further include a hoist velocity that may also be derived from the hoist position. A gantry crane may be a rubber tire gantry crane, a rail gantry crane and/or a quay crane.

FIG. 2 shows examples of gantry cranes 10 each with a machine state 70 that includes a hoist position 74, a spreader state 78 and may further include a hoist velocity 76 that may also be derived from the hoist position. A gantry crane may be a rubber tire gantry crane 12, a Rail Mounted Gantry (RMG) crane 14 and/or a quay crane 16, as will be shown in FIG. 3A.

Figure 3A:
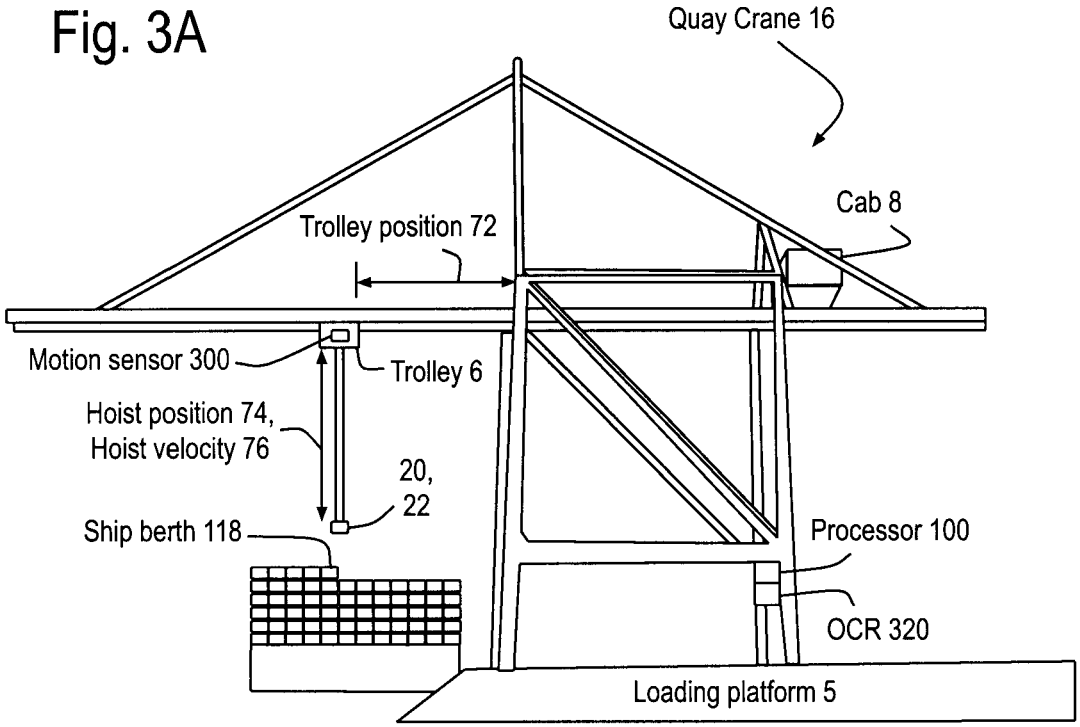
FIGS. 3A to 3C show an example of a quay crane accessing a hatch cover in FIG. 3B and a container in FIG. 3B from a ship berth with its trolley coupled to two of the motion sensors of FIGS. 1A to 1C. Comparing a first sensor height and the second sensor height to see if they are keeping up with the hoist position may determine when a hatch cover is being lifted and may avert container identification failure in an Optical Character Recognition system coupled to the quay crane as shown in FIG. 3A.
Figure 3B:
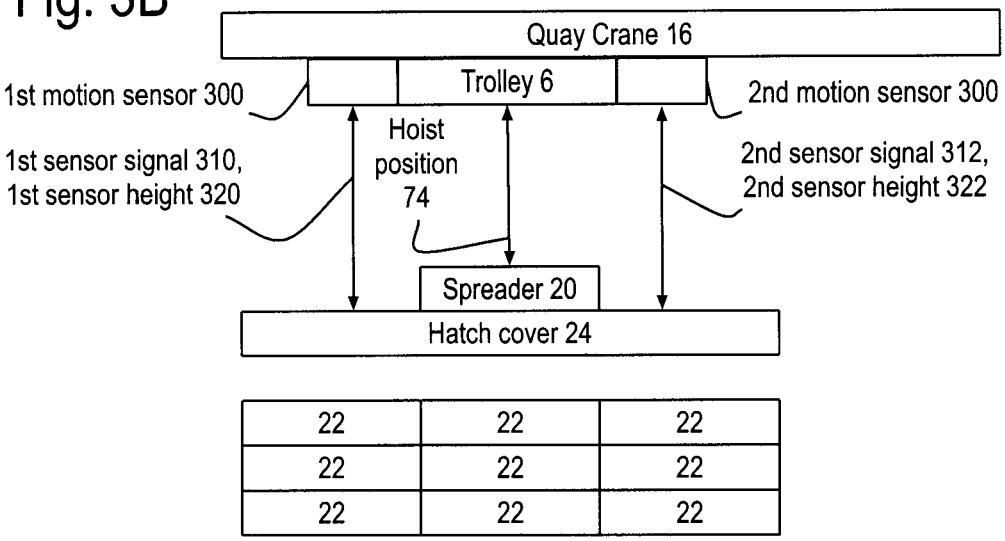
Figure 3C:
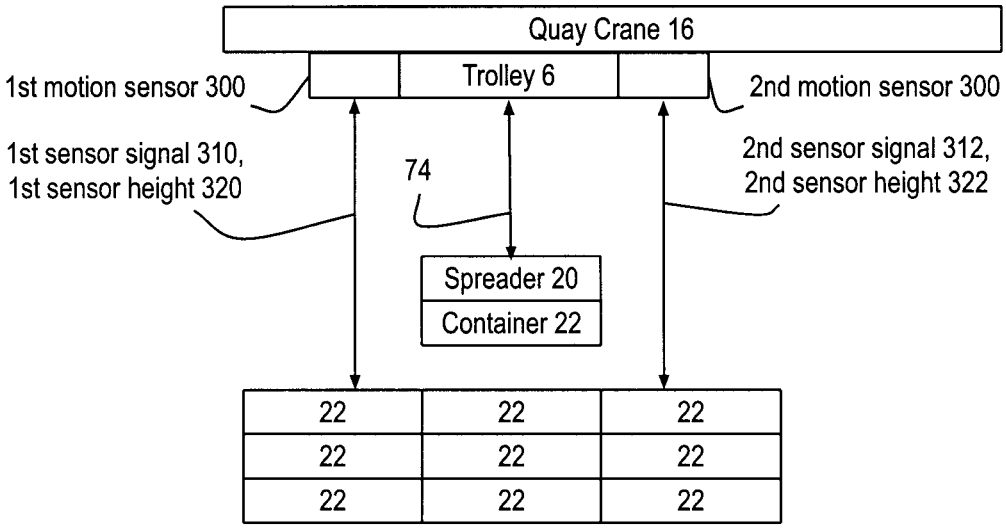

FIGS. 3A to 3C show an example of a quay crane 16 lifting a hatch cover 24 in FIG. 3B and a container 3C in FIG. 3C from a ship berth 118 of FIG. 3A with the crane's trolley 6 coupled to two of the motion sensors 300 of FIGS. 1A to 1C. Comparing the first sensor height 320 and the second sensor height 322 of FIGS. 3B and 3C to see if they are keeping up with the hoist position 74 may determine when the hatch cover 24 is being lifted. The processor 100 may perform this determination. The processor may or may not be part of the safety device 90 and/or part of the Optical Character Recognition (OCR) system 320 shown in FIG. 3A.

FIG. 3B shows the hatch cover 24 being lifted by the spreader 20. The first motion sensor 300 generates the first motion sensor signal 310 that is used to estimate the first sensor height 320. The second motion sensor 300 generates the second sensor signal 312 used to estimate the second sensor height 322. The spreader lifting the hatch cover is indicated when the first sensor height and the second sensor height essentially keep up with the hoist position 74. As used herein keeping up that changes in the hoist position occur with comparable changes in the sensor heights 320 and 322, to within at most ten percent and possibly less, such as a fixed minimum height difference such as at most six feet, possibly three feet and further possibly at most (not more than) two feet.

FIG. 3C shows a container 22 being lifted from the ship berth, with the first and second sensor heights 320 and 322 not keeping up with the hoist position 74.

Figure 4:
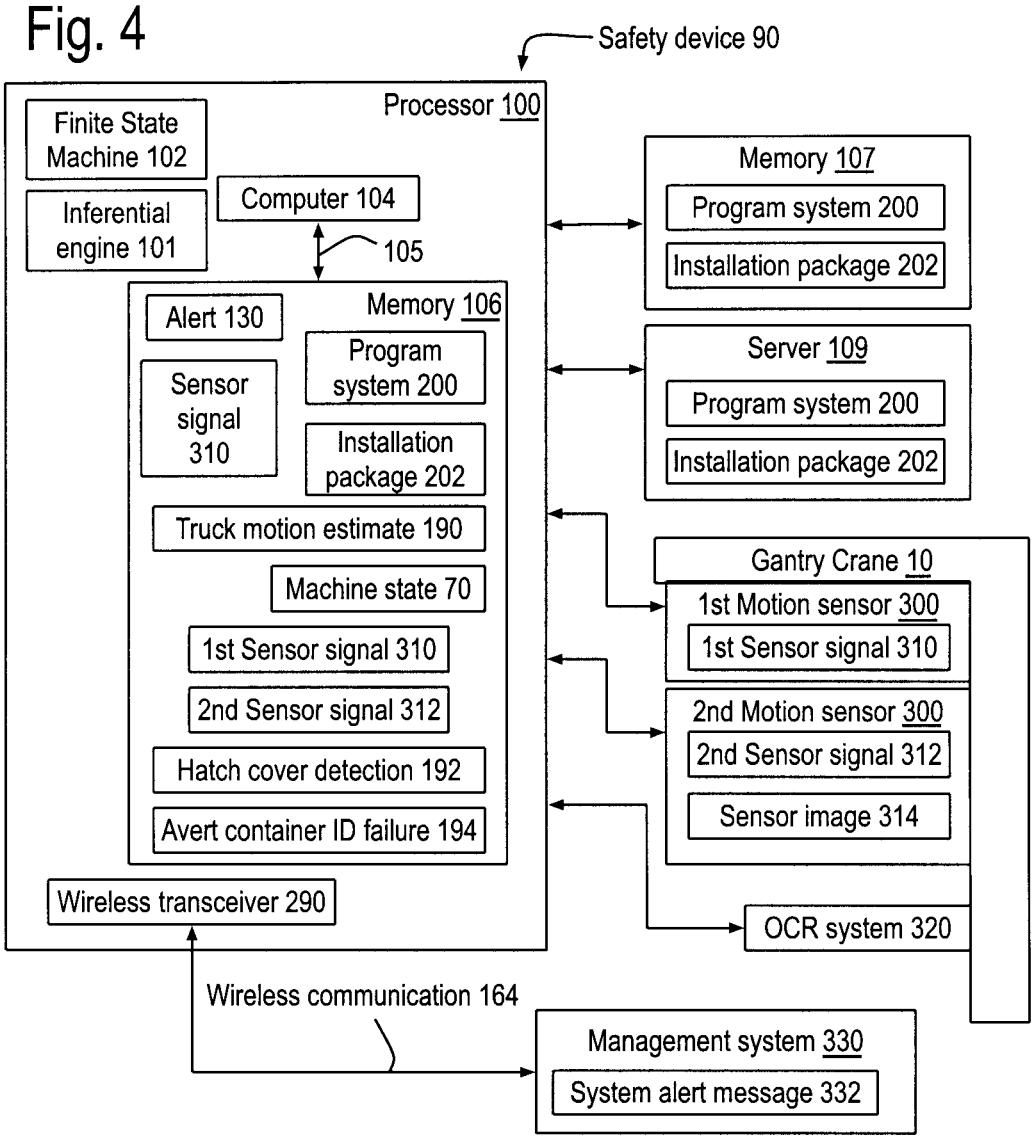
FIG. 4 shows a simplified block diagram of the processor possibly included in the safety device. The processor may include a computer instructed by a program system and/or an installation package either or both of which may be provided by a memory read by the processor and/or a server that communicates with the processor.

FIG. 4 shows a simplified block diagram of the processor 100 possibly included in the safety device 90. The processor may include a computer 104 instructed by a program system 200 and/or an installation package 202 either or both of which may be provided by a memory 107 read by the processor and/or a server 109 that communicates with the processor.

The processor 100 may include in a memory 106 at least one of the following: at least one form of the alert 130, the sensor signal 130, the truck motion 306 estimate 190, a machine state 70, possibly distinct sensor signals 310 and 312, an indication of detecting the hatch cover 192 and an indication to avert the container identification failure 194 of the OCR system 320. The alert 130 and/or the aversion of the container identification failure may be sent via a wireless transceiver 290 across at least one wireless communication transport 164 to a management system 330, possible as a system alert message 332.

The processor 100 may include at least one instance of an inferential engine 101, a finite state machine 102, the computer 104 and/or a computer accessible memory 106 configured to be accessed 105 by the computer to retrieve the program system 200 to instruct the computer to operate the processor as disclosed herein. In some embodiments, the inferential engine may retrieve rule sets and/or fact patterns from a memory 106 to create inferences that may alter the fact patterns and/or rule sets and/or direct the computer and/or processor.

As used herein, the computer 104 may include at least one instruction processor and at least one data processor, with each data processor directed by at least one of the instruction processors and with at least one of the instruction processors at least partly implementing the operations of the processor 100 as disclosed herein through the discussion that follows regarding the program system 200. These operations may be at least partly illustrated through flowcharts showing program steps that may reside in the computer accessible memory 106, which may include volatile and/or non-volatile memory components.

The motion sensor 300 may generate at least one sensor signal 310. In situations where multiple motion sensors may be installed for examples by coupling to two ends of the trolley 6, one of these sensors, for example the second motion sensor may generate a second sensor signal 312 that may either include a sensor image 314 generating by an imaging device 308 and/or the sensor image may be separately generated and sent to the safety device 90 and/or the processor 100. The processor may use the sensor image to determine if the truck 2 is coupled to the chassis 3 as well as at least partly determine the truck motion estimate 190. In certain embodiments, the processor may store more than one sensor reading and/or sensor image to create the truck motion estimate.

Figure 5:
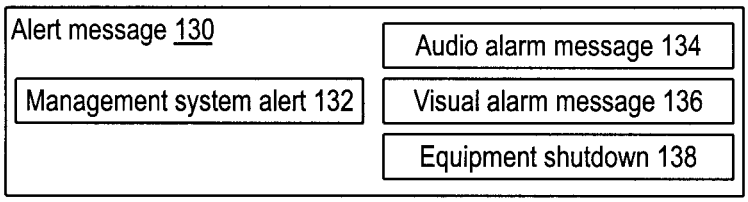
FIG. 5 shows some details of the alerts of the previous Figures.

FIG. 5 shows some details of the alerts 130 as messages that may include a management system alert 132, an audio alarm message 134, a visual alarm message 136 and/or an equipment shutdown message 138. Note that in particular, the audio alarm message and/or the equipment shutdown message may include a digital and/or an analog component. Note that the system alert message 332 of FIG. 4 may include the management system alert 132 of the safety device 90 as well as the indication to avert the container identification failure 194 regarding the OCR system 320.

The Figures show several flowcharts of some details of the program system 200 and/or the installation package 202 instructing the processor 100. These flowcharts show some method embodiments, which may include arrows signifying a flow of control and/or state transitions as well as sometimes position data, supporting various implementations. These may include a program operation, or program thread, executing upon the computer 104 or states of the finite state machine 102. Each of these program steps may at least partly support the operation to be performed. The operation of starting a flowchart refers to entering a subroutine or a macroinstruction sequence in the computer or of a possibly initial state or condition of the finite state machine. The operation of termination in a flowchart refers to completion of those operations, which may result in a subroutine return in the computer or possibly return the finite state machine to a previous condition or state. A rounded box with the word "Exit" in it denotes the operation of terminating a flowchart.

Figure 6:
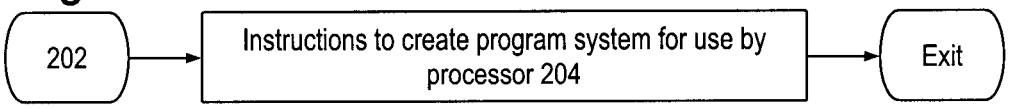
FIG. 6 shows a flowchart some details of the installation package of FIG. 4 at least partly creating the program system.

FIG. 6 shows a flowchart some details of the installation package of FIG. 4 at least partly creating the program system 200 for use by the processor 100 as one or more instructions that may be executed by the computer 104 and/or the finite state machine 102.

Figure 7:
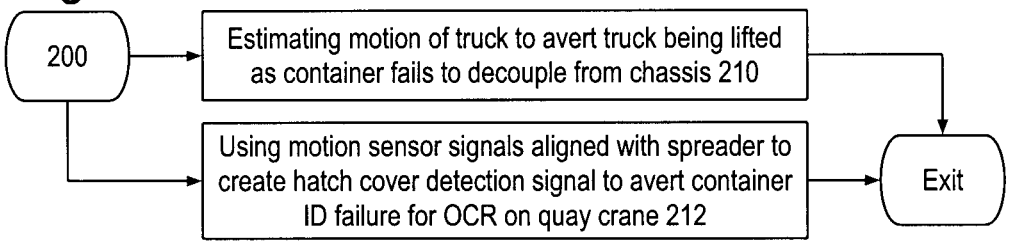
FIGS. 7 to 16 show flowcharts of the program system that support averting lifting the truck when the container fails to decouple from the chassis and/or avert a container identification failure when a hatch cover is lifted off of a ship.

FIG. 7 shows a flowchart of the program system 200 supports averting lifting the truck when the container fails to decouple from the chassis and/or averting a container identification failure when a hatch cover is lifted off of a ship. The program system includes any combination of the following: Program step 210 supports estimating the motion 306 of the truck 2 to avert 130 the truck being lifted off of the landing platform 5 as the container 22 fails to decouple from the chassis as shown in FIGS. 1A to 1C. Program step 212 supports using the motion sensor signals 310 and 312 aligned with the spreader 20 to create the hatch detection signal 192 to avert the container identification failure 194 of the OCR system 320.

FIGS. 8 to 13 show flowcharts of the program system 200 that support program step 210 averting lifting the truck 2 when the container 22 fails to decouple from the chassis 3 as shown in FIGS. 1A to 1C.

Figure 8:
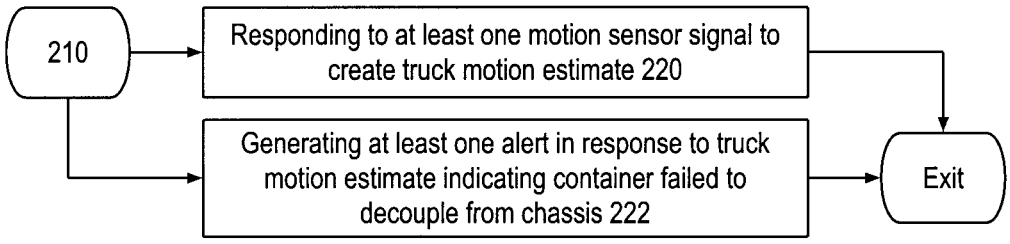

FIG. 8 shows a flowchart of program step 210 that includes at least one of the following: Program step 220 supports responding to at least one of the motion sensor signals 310 and/or 312 to create the estimate 190 of the truck motion 306. In certain embodiments where the motion sensor 300 includes an imaging device 308 as shown in FIG. 1B, the truck motion estimate 190 may further include an indication of whether the truck 2 is coupled to the chassis 3. Program step 222 supports generating at least one alert 130 to avert lifting the truck 2 off of the loading platform 5 in response to the truck motion estimate 190 indicating that the container 20 failed to decouple from the chassis 3.

Figure 9:
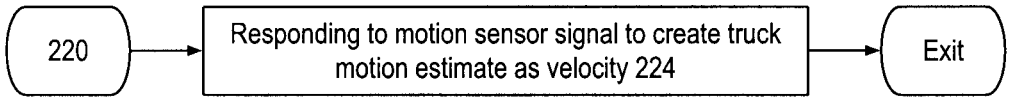

FIG. 9 shows a flowchart of program step 220 of some details of responding to at least one of the motion sensor signals 310 and/or 312 to create the estimate 190 of the truck motion 306 as a velocity.

Figure 10:
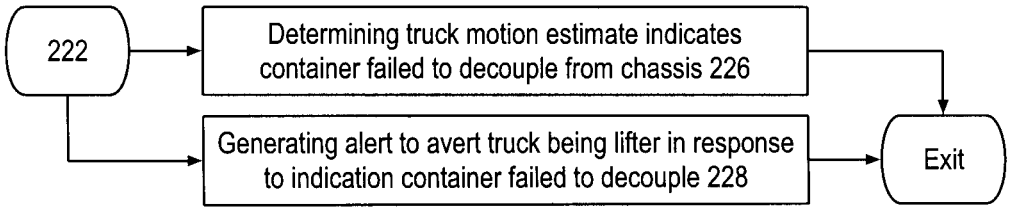

FIG. 10 shows a flowchart of program step 222 some details generating the alert to avert lifting the truck. Program step 226 supports determining the truck motion estimate 190 indicated the container 22 failed to decouple from the chassis 3. Program step 228 supports generating at least one alert 130 in response to the indication that the container failed to decouple.

Figure 11:
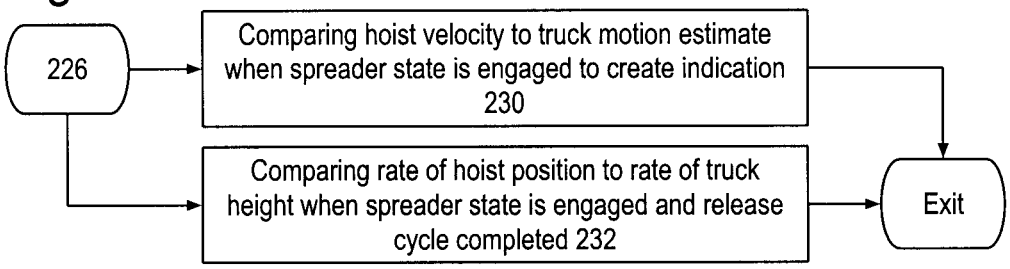

FIG. 11 shows a flowchart of a refinement of program step 226 as including at least one of the following: Program step 230 supports comparing the hoist velocity 76 to the truck motion estimate 190 when the spreader state 78 is engaged to create the indication that the container 22 failed to decouple from the chassis. Program step 232 supports the rate of change of the hoist position 74 to the rate of change of the truck height 306 when the spreader is engaged and the release cycle is completed. As used herein, the release cycle include the disengagement of the chassis to container coupling and the lifting of the container by the spreader to the point when there is no weight from the container remaining on the chassis.

Figure 12:
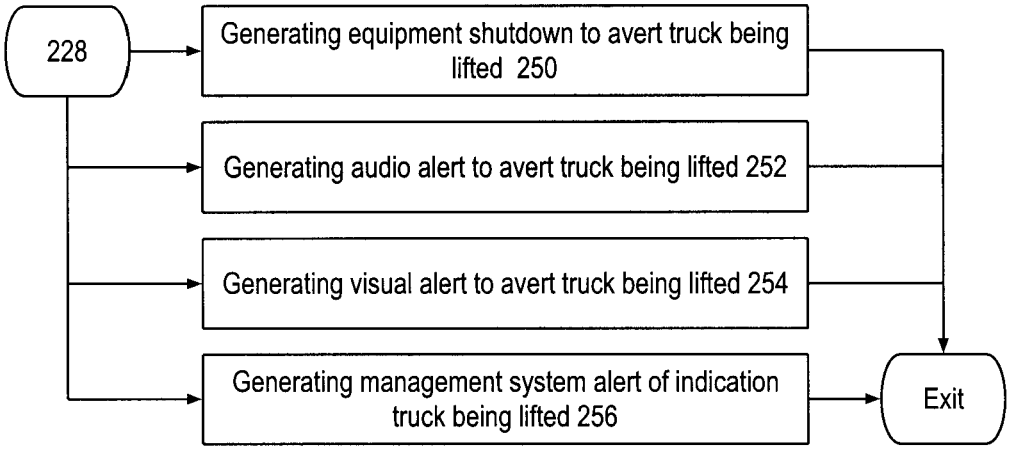

FIG. 12 shows a flowchart of program step 228 generating at least one alert to avert lifting the truck by including one or more of the following: Program step 250 supports generating the equipment shutdown 138. Program step 252 supports generating the audio alert 134. And program step 254 supports generating the visual alert 136.

FIG. 12 also shows program step 228 including program step 256, which supports generating the management system alert 132 of the indication that the truck 2 being lifted.

FIGS. 13 to 16 show some detail flowcharts of the program step 212 averting 194 the container identification failure OCR system 320 when a hatch cover 24 is lifted off of a ship as shown in FIG. 3B.

Figure 13:
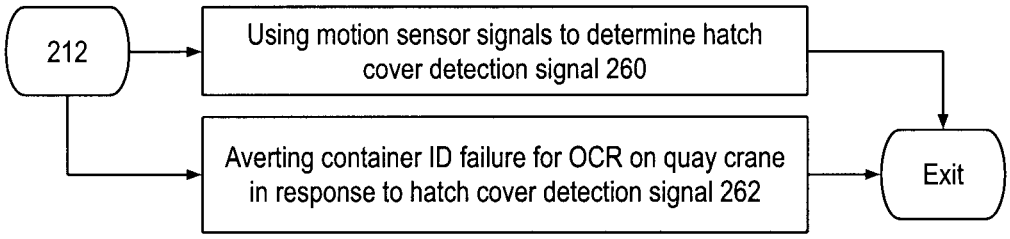

FIG. 13 shows a flowchart of program step 212 averting 194 the container identification failure OCR system 320 when a hatch cover 24 is lifted off of a ship as including at least one of the following: Program step 260 supports using the motion sensor signals 310 and 312 to determine the hatch cover detection signal 192 as discussed in FIG. 3B. Program step 262 supports averting 194 the container identification failure in the OCR system 320 in response to the hatch cover detection signal.

Figure 14:
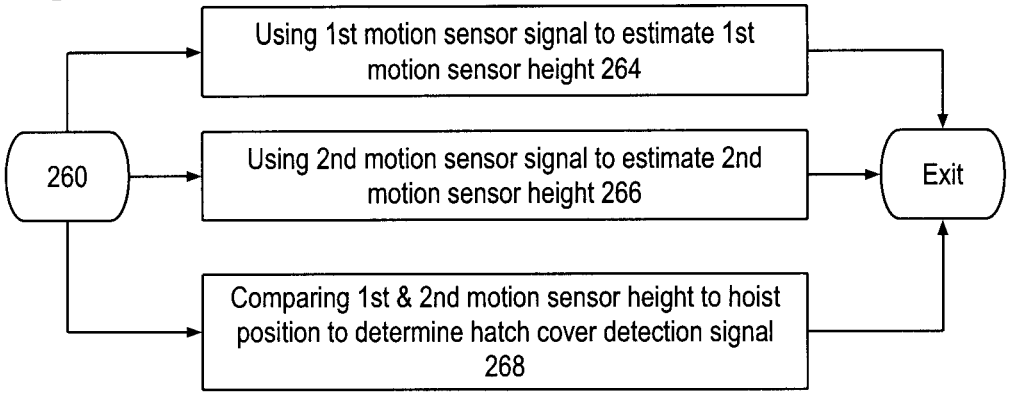

FIG. 14 shows a flowchart of some details of program step 260 using the motion sensor signals to determine the hatch cover detection signal by including at least one of the following: Program step 264 supports using the first motion sensor signal 310 to estimate the first motion sensor height 320 as shown in FIGS. 3B and 3C. Program step 266 supports using the second motion sensor signal 312 to estimate the second motion sensor height 322. Program step 268 supports comparing the first and second motion sensor heights with the hoist position to determine the hatch cover detection signal 190 in accord with the discussion of FIG. 3B.

Figure 15:
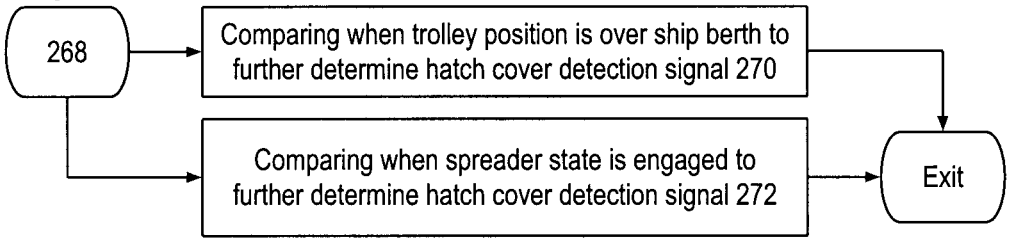

FIG. 15 shows a refinement of the flowchart of program step 268 that may include any combination of the following: Program step 270 supports comparing when the trolley position 72 is over the ship berth 118 as shown in FIG. 3A to further determine the hatch cover detection signal 192. Program step 272 supporting comparing when the spreader state 78 is engaged to further determine the hatch cover detection signal. As used herein, the spreader 20 is prepared to move a container 22 or a hatch cover 24 when the spreader state 78 is engaged. When not engaged the spreader will not correctly move either the container or the hatch cover.

Figure 16:
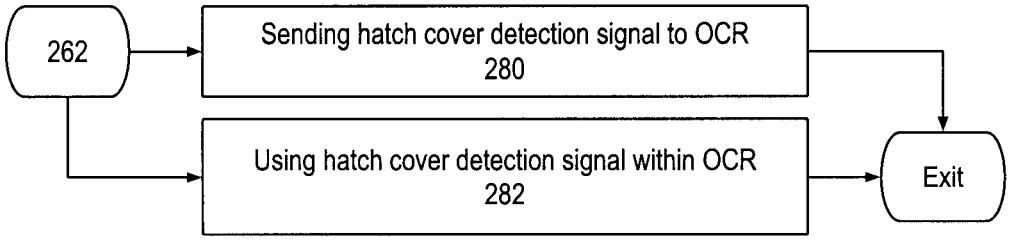

FIG. 16 shows a flowchart of some details of program step 262 averting 194 the container identification failure in the OCR system 320 in response to the hatch cover detection signal 192 by possibly including one or both of the following: Program step 280 supports sending the hatch cover detection signal to the OCR system. Program step 282 supports using the hatch cover detection signal within the OCR system. By way of example, program step 280 may be used when the processor 100 is outside of the OCR system or the communication between the processor and the OCR system uses a network not completely within the OCR system. Program step 282 may be used at the reception of the hatch cover detection signal without any need for a network.

Figure 17A:
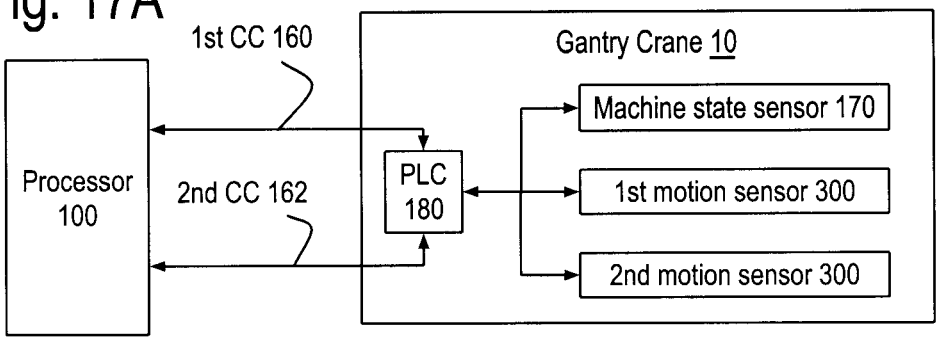
FIGS. 17A to 17C shows the processor communicating through any combination of a Programmable Logic Controller interface, a wireline interface and/or a relay interface.
Figure 17B:
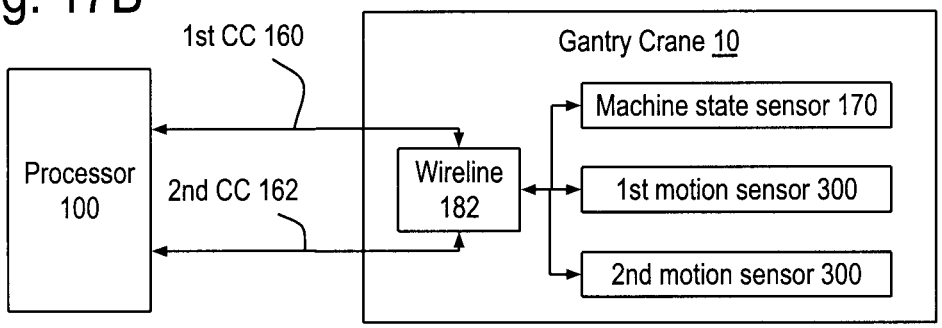
Figure 17C:
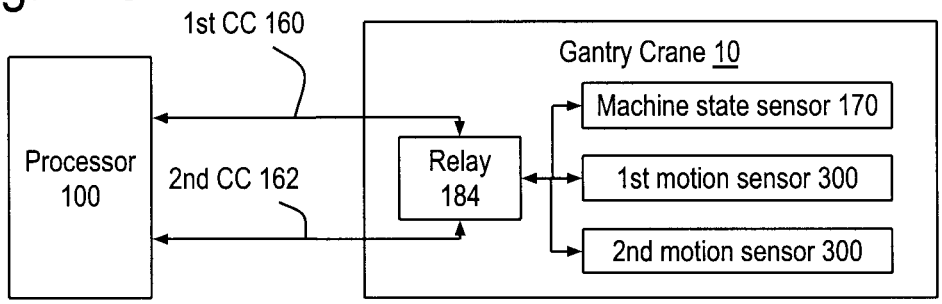

FIGS. 17A to 17C shows the processor communicating through any combination of a Programmable Logic Controller interface, a wireline interface and/or a relay interface.

FIGS. 17A to 17C shows some examples of the first communicative coupling 160 and/or the second communicative coupling 162 to communicate with at least one machine state 170 and/or at least one yard state sensor 150. FIG. 17A uses a Programmable Logic Controller (PLC) 180. FIG. 17B uses a wireline interface 182. And FIG. 17C uses a relay interface 184. The wireline interface may for example be compatible with a form of Ethernet, RS-232, RS-422 and/or ICANN.

Figure 18:
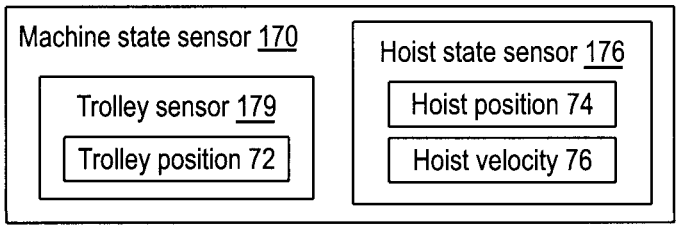
FIG. 18 shows some details of the machine state sensor.

FIG. 18 shows some examples of the machine state sensor 170 that may include at least one instance of at least one of the following: A spreader state sensor 174 for the spreader state 78. A hoist state sensor 176 may be an reading of a gray scale coded wheel mounted in the hoist drum or on its axle that is used to calculate the hoist position 74 and the hoist velocity 76. And a trolley sensor 159 for the trolley position 72.

Figure 19:
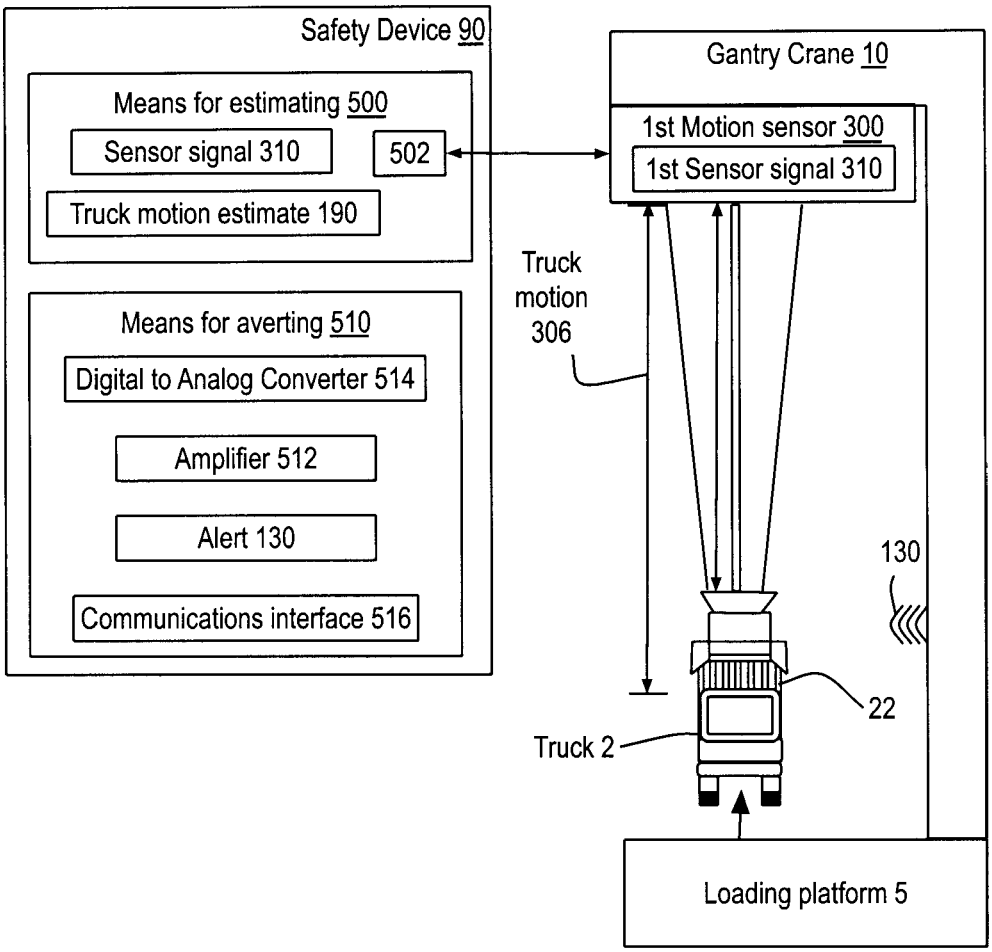
FIG. 19 shows that in certain alternative embodiments the safety device may include means for estimating the movement of the truck to create the truck motion estimate and/or the means for averting the truck being lifted based upon the truck motion estimate indicating that the container has failed to decouple from the chassis as shown in FIG. 1A.

FIG. 19 shows that in certain alternative embodiments the safety device 90 may include means for estimating 500 the movement 306 of the truck 2 to create the truck motion estimate 190 and/or the means for averting 130 the truck being lifted based upon the truck motion estimate indicating that the container 20 has failed to decouple from the chassis 3 as shown in FIG. 1A.

The means for averting 510 may include an amplifier 512, a digital to analog converter 514 and/or a communications interface 516 similar to the wireless transceiver 290 of FIG. 4, the wireline communications interface 182 of FIG. 17B, the PLC interface 180 of FIG. 17A and/or the relay interface 184 of FIG. 17C, any or all of which may be configured to send the alert 130.

In certain embodiments, at least one of the means for estimating 500 and the means for averting 510 includes at least one instance of at least one of a finite state machine 102, a computer 104 accessibly coupled 105 to a memory 106 containing a program system 200 configured to instruct the computer, and/or an inferential engine 101.

The means for estimating 500 may include at least one means for responding 502 to at least one motion sensor signal 310 to create the truck motion estimate 190. Some examples of the means for responding may use an interrupt on the computer and/or a polling scheme to create the truck motion estimate.

The preceding embodiments provide examples and are not meant to constrain the scope of the following claims.

What is claimed is:

1. A safety system adapted for attachment to a crane, comprising:

a motion sensor attached to a crane trolley, comprising:

a light source positioned to emit light downward onto a truck coupled to a chassis carrying a container when the crane trolley is positioned for lifting the container; and a light detector positioned to receive light from the light source reflected upward from the truck;

a processor attached to the crane, said processor configured to create an estimate of truck motion in response to a motion sensor signal from said motion sensor; and an alert generated by said processor when said estimate of truck motion indicates the container failed to decouple from the chassis, wherein said safety system is configured to avert the truck from being lifted by the crane when said processor generates said alert.

2. The safety system of claim 1, wherein the crane is at least one of a rubber tire gantry crane, a rail gantry crane, and a quay crane.

3. The safety system of claim 1, wherein said processor is further configured to receive said motion sensor signal through interactions with at least one of a Programmable Logic Controller (PLC) interface, a relay interface and a wireline communications interface compatible with at least one wireline communications standard.

4. The safety system of claim 3, wherein said wireline communications standard includes a version of at least one of a Synchronous Serial Interface (SSI) protocol, an Ethernet protocol, a Serial Peripheral Interface (SPI), an RS-232 protocol, an Inter-IC (I2C) protocol, an Universal Serial Bus (USB) protocol, a Controller Area Network (CAN) protocol, a Firewire protocol, the Institute for Electrical and Electronic Engineers (IEEE) 1394 communications standard, an RS-485 protocol, and an RS-422 protocol.

5. The safety system of claim 1, wherein said processor is communicatively coupled to at least one instance of at least one of an amplifier, a digital to analog converter, and a communications interface configured to use at least one communication protocol, each configured to send said alert to avert the truck being lifted.

6. The safety system of claim 1, wherein said processor includes at least one instance of at least one of a finite state machine, a computer instructed by a program system including program steps residing in a memory accessibly coupled to said computer, and an inferential engine.

7. The safety system of claim 6, wherein said program steps includes at least one of:

responding to said motion sensor signal to create said truck motion estimate; and generating said alert in response to said truck motion estimate indicating the container being lifted failed to decouple from the chassis.

8. The safety system of claim 6 further comprising a computer readable memory accessible to said computer, and including at least one of said program system and an installation package containing at least one instruction to configure said memory with said program system.

9. The safety system of claim 8 further comprising a server configured to communicate to said computer at least one of said program system and an installation package containing at least one instruction to configure said memory with said program system.

10. The safety system of claim 1, wherein said alert comprises at least one of a management system alert, an audio alarm message, a visual alarm message, and an equipment shutdown message.

11. The motion sensor of claim 1, wherein said light source includes at least one of a laser and a light emitting diode.

12. The safety system of claim 1, further comprising a second of said motion sensor attached to the crane trolley, wherein said processor is further configured to use motion sensor signals from said two motion sensors to create a hatch cover detection signal when the crane trolley is positioned over a container coupled to a hatch and to avert a container identification failure event for an Optical Character Recognition (OCR) System in response to said hatch cover detection signal.

13. The safety system of claim 12, wherein said processor further comprises a program system residing in a memory accessibly coupled to said processor, said program system including at least one of the program steps of:

using said motion sensor signals from said two motion sensors to create said hatch cover detection signal; and averting the container identification failure event for said OCR System in response to said hatch cover detection signal.

14. The safety system of claim 13, wherein the program step of averting further comprises the program step of sending a message to said OCR system to avert the container identification failure.

* * * * *